US010072893B2

(12) United States Patent
Prieels

(10) Patent No.: US 10,072,893 B2
(45) Date of Patent: Sep. 11, 2018

(54) EXCHANGER BODY AND EXCHANGER

(71) Applicant: ATELIERS DE CONSTRUCTION DE THERMO-ECHANGEURS SA, Naninne (BE)

(72) Inventor: Luc Prieels, Melin (BE)

(73) Assignee: ATELIERS DE CONSTRUCTION DE THERMO-ECHANGEURS SA, Naninne (BE)

( * ) Notice: Subject to any disclaimer, the term of this patent is extended or adjusted under 35 U.S.C. 154(b) by 483 days.

(21) Appl. No.: 14/385,636

(22) PCT Filed: Mar. 18, 2013

(86) PCT No.: PCT/BE2013/000013
§ 371 (c)(1),
(2) Date: Sep. 16, 2014

(87) PCT Pub. No.: WO2013/142924
PCT Pub. Date: Oct. 3, 2013

(65) Prior Publication Data

US 2015/0090431 A1 Apr. 2, 2015

(30) Foreign Application Priority Data

Mar. 16, 2012 (BE) ..... 2012/0185

(51) Int. Cl.
*F28D 9/04* (2006.01)
*F28F 3/04* (2006.01)
*F28F 9/02* (2006.01)

(52) U.S. Cl.
CPC ..... *F28D 9/04* (2013.01); *F28F 3/04* (2013.01); *F28F 3/046* (2013.01); *F28F 9/02* (2013.01); *F28F 9/0263* (2013.01); *F28F 2265/26* (2013.01)

(58) Field of Classification Search
CPC ..... F28D 9/04; F28F 3/04; F28F 3/046
USPC ..... 165/164, DIG. 398
See application file for complete search history.

(56) References Cited

U.S. PATENT DOCUMENTS 4,124,069 A * 11/1978 Becker ..... B01D 5/0003 165/164
6,289,978 B1 * 9/2001 Antoine ..... F28D 9/0018 165/164
2005/0159618 A1 * 7/2005 Hechler ..... C07C 45/35 562/545

(Continued)

FOREIGN PATENT DOCUMENTS

DE 1551524 A1 1/1970
DE 3234878 * 3/1984

(Continued)

OTHER PUBLICATIONS

Gueguen, FR2810726TRANS (English Translation), Dec. 2001.*

(Continued)

*Primary Examiner* — Len Tran
*Assistant Examiner* — Eric Ruppert
(74) *Attorney, Agent, or Firm* — Hovey Williams LLP

(57) ABSTRACT

The invention relates to an exchanger body comprising:—an element wound in a spiral and consisting of two sheets of heat-conducting material which define channels for a fluid between one another,—at least one distributor, and—at least one collector.

24 Claims, 16 Drawing Sheets

(56) References Cited

U.S. PATENT DOCUMENTS

2008/0257534 A1* 10/2008 Bachmaier ..... F28D 9/04
165/164

FOREIGN PATENT DOCUMENTS

| | | | | |
|---|---|---|---|---|
| DE | 3418561 | A1 | | 11/1985 |
| FR | 2810726 | | * | 12/2001 |
| WO | 9619707 | A1 | | 6/1996 |
| WO | 9715344 | A1 | | 5/1997 |
| WO | 2007017273 | A2 | | 2/2007 |
| WO | WO2008052493 | | * | 5/2008 |

OTHER PUBLICATIONS

Peschke, DE3234878TRANS (English Translation), Mar. 1984.*
Bachmaier, WO2008052493TRANS (English Translation), May 2008.*
International Search Report dated Jul. 4, 2013 in Corresponding PCT/BE2013/000013 (3 pages).

* cited by examiner

EXCHANGER BODY AND EXCHANGER

The subject of this invention is a heat exchanger between at least a first fluid and a second fluid.

Numerous heat exchanger bodies have already been proposed. According to one proposal an element consisting of two sheets attached to each other is wound to define a passage for a first fluid between the spirals on the one hand and a passage for the second fluid between the sheets of the element on the other hand. An exchanger made of polymer material is known through document DE3418561 for example, the exchanger body comprising two walls connected to each other and wound in a spiral to define a passage or channel substantially in a spiral between an inlet adjacent to one end of the body in a spiral and an outlet adjacent to the other end of the body in a spiral. Such an exchanger body has the disadvantage of creating a very large loss of load and only providing limited heat exchange through the choice of materials and through the direction of flow of the fluid in the channel in a spiral in relation to the direction of the fluid flowing between the faces of two adjacent spirals.

The applicant has observed that by using an element consisting of two sheets made of a heat conducting material with at least the following features:

- these sheets are connected to each other at least in the vicinity of their longitudinal edges to define one or several internal channels for this second fluid FA between them,
- this element being wound to form a structure at least partially in a spiral extending into this conduit so as to define one or several channels for the first fluid FB in the conduit between the faces of adjacent spirals,
- the first sheet and the second sheet forming the element are deformed to form a first series of channels and a second series of channels respectively, the edge of the channels of the first series of the first sheet turned towards the second sheet contacting the edge of the channels of the second series of the second sheet, forcing this second fluid to follow a path between the distributor and the collector formed by both the channels of the first series and the channels of the second series, it was possible to provide excellent heat exchange, whilst limiting or preventing substantially, even completely (in heat exchange between a hot fluid with a temperature of less than 350° C. and a cold fluid with a temperature of more than 10° C., less than 75° C. on average for example) the problems of relative expansion between the sheets, particularly between the longitudinal edges of the element.

According to the invention the exchanger body adapted to be placed in a conduit or a chamber to guide the flow of the first fluid in or towards the exchanger body comprises:

- an element adapted to be situated at least partially in this conduit, this element consisting of two sheets made of a heat conducting material, these sheets being connected to each other at least in the vicinity of their longitudinal edges to define one or several internal channels for this second fluid between them, this element being wound to form a structure at least partially in a spiral extending into this conduit so as to define one or several channels for the first fluid in the conduit between the faces of adjacent spirals,
- at least one, preferably at least two substantially radial distributors to convey this second fluid in the element in the vicinity of a first longitudinal edge at the level of the different spirals and at least one, preferably at least two substantially radial collectors to collect this second fluid after its passage in this element, this collector being adapted to collect this second fluid in the vicinity of the second longitudinal edge at the level of the different spirals, in which the first sheet and the second sheet forming the element are deformed to form a first series of channels and a second series of channels respectively, the edge of the channels of the first series of the first sheet turned towards the second sheet contacting the edge of the channels of the second series of the second sheet, forcing this second fluid to follow a path between the distributor and the collector, this path being formed by both the channels of the first series and the channels of the second series.

In this document "sheet made of a heat conducting material" is understood to be a sheet with an average thickness of less than 3 mm, advantageously less than 2 mm, preferably less than 1 mm, from 0.1 mm to 0.7 mm for example, or a sheet with areas of average thickness of less than 3 mm, advantageously less than 2 mm, preferably less than 1 mm, from 0.1 mm to 0.7 mm for example, and/or a sheet made of a material with a heat transfer coefficient of more than 0.01 W/m·K, advantageously more than 1 W/m·K, preferably more than 20 W/m·K. The sheet made of a heat conducting material preferably is not very thick (less than 2 mm for example) or has areas that are not very thick and a heat transfer coefficient of more than 20 W/m·K.

Some or the channels or a part of them advantageously extend in a direction forming an angle in relation to the central axis of the spiral, an angle of 15° to 60° for example, particularly about 30° to 45°.

The first and second sheets advantageously are metallic, particularly made of stainless steel with a low carbon content, with a carbon content of less than 0.2% in weight for example. The stainless steel is of the ferritic type in particular.

According to a specific embodiment the first and second sheets are made of steels with different expansions so that the sheet turned towards the outside of a spiral has an expansion coefficient that is more than that of the sheet turned towards the inside of the spiral in question.

The choice of stainless steel may include steels with a heat conductivity at 100° C. of more than 20 W/m·° C. for example, advantageously between 25 and 35 W/m·° C. (particularly at least more than 26 W/m·° C., and a heat expansion coefficient for both the range from 0 to 200° C. and from 0 to 600° of less than 12 $10^{-6}$/° C., particularly less than 11.5 $10^{-6}$/° C. 409/410 steels with 10 to 14% Cr, 430 steel with 14 to 17% chromium, steels with a high chromium content (17% to 30%), 430Ti, 439 and 441 stabilised steels, etc, may be quoted for example.

Austenitic stainless steels may also be quoted, more specifically those of the 300 series, such as 304, 309, 310, 316, 317, 321, 347 and 348 stainless steels, etc, duplex stainless steels, S32101, S32304, S32003, S31803 and S32205 steels for example, ATI 20–25+Nb® alloys, AFA (alumina-forming stainless steels) alloys, nickel based alloys, 600, 601, 625, 617 and 718 alloys for example, Inconel, X alloy, 214 alloy, etc, and titanium based alloys, etc.

The sheets may also be made of organic material, particularly polymer, advantageously reinforced by fibres (in the form of fabric or a mat for example) and advantageously loaded with material with a heat transfer coefficient of more than 1 W/m·K, advantageously more than 10 W/m·K, preferably more than 20 W/m·K. The following materials may be quoted as the organic material for example: PE, PP, PET, ABS, PC, PEEK, PVDF, etc, whereas copper filings and/or particles and carbon black, etc, may be quoted as the load for example.

The problems connected with the heat expansion between the sheets wound in a spiral may also be controlled by areas with a suitable radius of curvature allowing relative movement between the sheets during heat expansion.

The sheets may also have a composite structure, a metallic layer and one or several organic layers for example.

In advantageous embodiments the exchanger body has one or several of the following characteristics:

- the depth of the channels of the first series and the second series is less than 10 mm, advantageously less than 7 mm, preferably less than 5 mm, specifically between 1 mm and 4 mm, and/or
- the maximum width of the channels of the first series or the second series is less than 30 mm, advantageously less than 15 mm, preferably less than 10 mm, between 1 mm and 6 mm for example, and/or
- the radial distance separating the faces of two successive spirals turned towards each other is between 1 mm and 100 mm, advantageously between 5 mm and 70 mm, preferably between 10 mm and 50 mm, and/or
- the path between the distributor and the collector has at least one local curved component following at least the winding of a spiral, particularly over an angular area of 10°, advantageously at least 15°, preferably from 30° to 90°, 35°, 40°, 45° and 50° for example, and/or
- the path between the distributor and the collector has an axial component, the length of which corresponds substantially to the axial length of the exchanger body, and/or
- the sheets forming the element in a spiral are welded to each other substantally along their longitudinal edges in a discontinuous way between these longitudinal edges and/or
- the sheets are welded together or attached to each other in a series of areas and/or points between these longitudinal edges of the sheets and/or
- the number of areas and/or points for attaching, for welding for example, the sheets to each other between their longitudinal edges is more than 100 per $m^2$, advantageously more than 1000 per $m^2$, preferably more than 5000 per $m^2$, these welding points advantageously being distributed in a substantially homogenous way and/or
- the exchanger body comprises one or several means for controlling the expansion of the portions of the spirals extending between two successive distributors or two successive collectors and/or
- the means for controlling the expansion of the portions of the spirals extending between two distributors or two collectors are aligned substantially along a radial plane and/or
- the distributors or the collectors have a passage section that widens the further away from the central axis of the exchanger body it is and/or
- the or one or several of the distributors and/or collectors are associated with at least one means for guiding the first fluid entering into the space between the spirals and/or
- the exchanger body has a central axial channel serving either to convey the second fluid towards the distributors or to receive the second fluid coming from the collectors or to connect two successive exchanger bodies or to receive another exchanger body.

The subject of the invention is also an exchanger comprising at least one chamber housing at least one exchanger body according to the invention with one or several of the characteristics given in any one of the enclosed claims and at least one distributor or a chamber to distribute the first fluid between the spirals of the exchanger. The exchanger advantageously comprises conduits to convey and remove this first fluid and this second fluid as well as advantageously a chamber to collect the first fluid after its passage through the exchanger body.

The subject of the invention is also a method for transferring calories of frigories between at least a first fluid and a second fluid by means of an exchanger according to the invention,

- in which the first fluid is conveyed in the channels formed between the faces of adjacent spirals of the element wound at least partially in a spiral,
- in which the second fluid is distributed via one, but advantageously several radial distributors in the internal channels of the element in the vicinity of a first longitudinal edge of the element and in which the second fluid is collected after its passage in the internal channels of the element via one or several radial collectors.

Features and details of the invention will be found in the following detailed description, in which reference is made to the enclosed drawings.

In these drawings.

FIGS. 22A, 22B, 22C, 22D and 22 E are sectional views of various embodiments of two sheets connected to each other by different means and FIGS. 23A to 23H are sectional views of two sheets attached to each other.

In the enclosed description of embodiments given only as examples the same reference marks indicate elements that are identical or have the same function.

Figure 1:
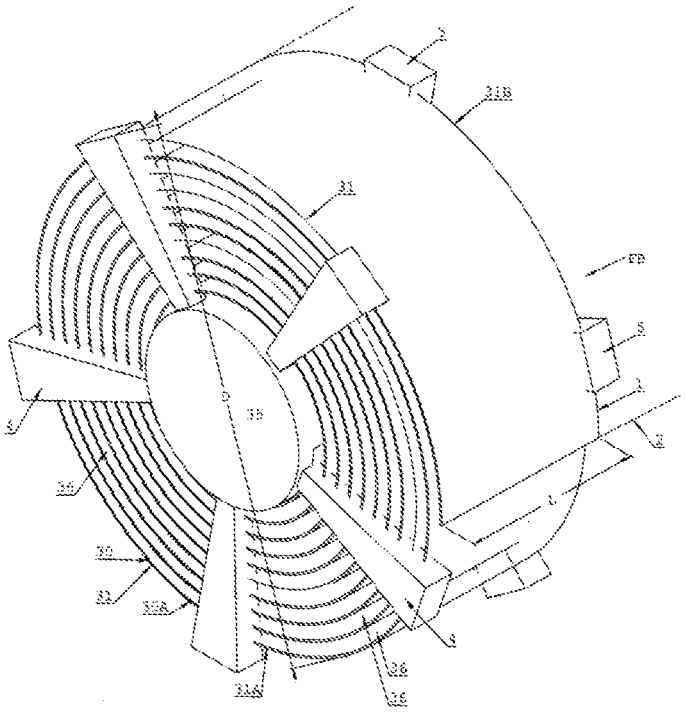
FIG. 1 is a perspective view of an exchanger body according to the invention.
Figure 3:
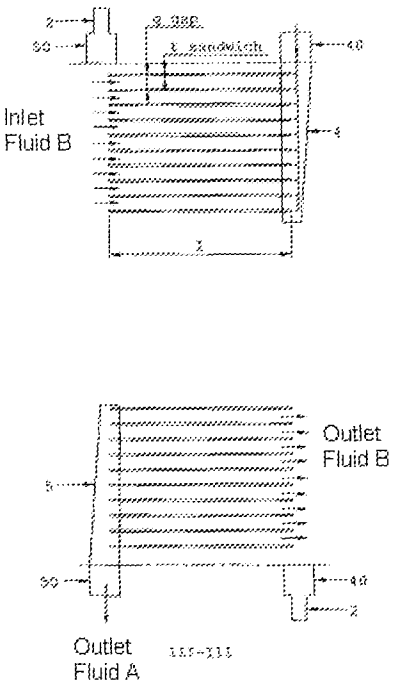
FIG. 3 is a sectional view along line III-III of the exchanger body in FIG. 1.
Figure 2:
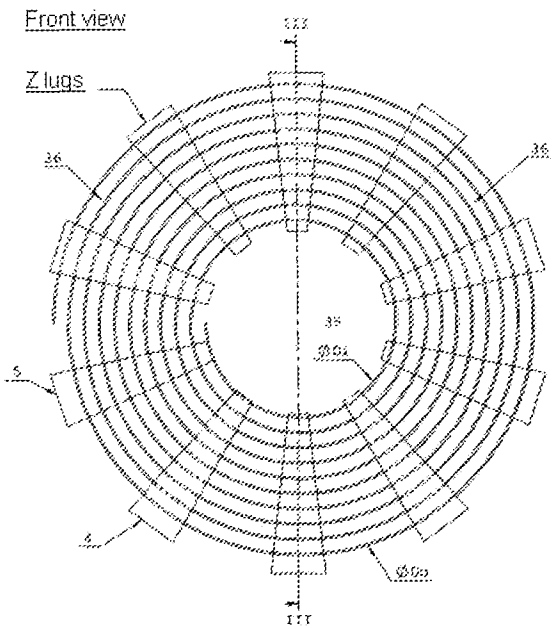
FIG. 2 is a front view of the exchanger body in FIG. 1.
Figure 15:
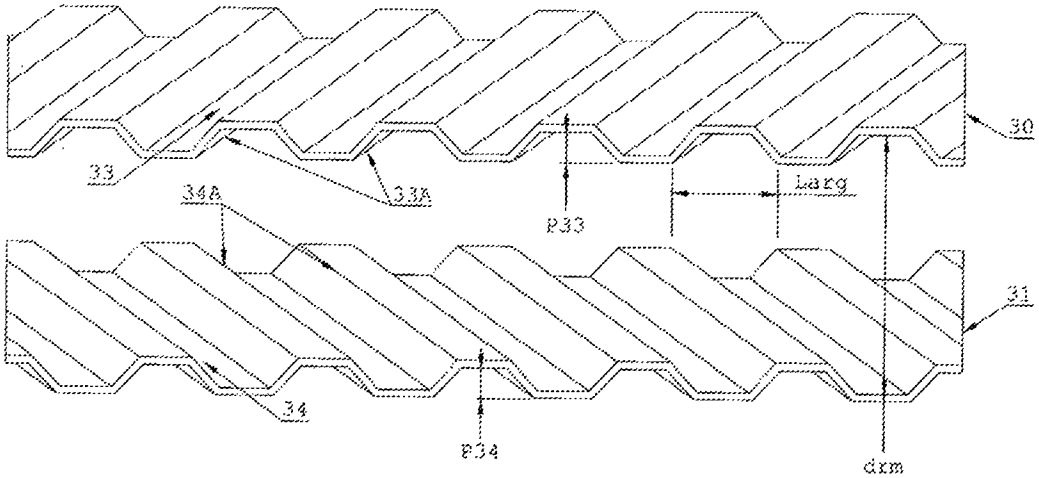
FIG. 15 is a larger scale, partially exploded view of a section of two sheets attached, welded for example, to each other to define the element in which the second fluid FA flows.
Figure 16:
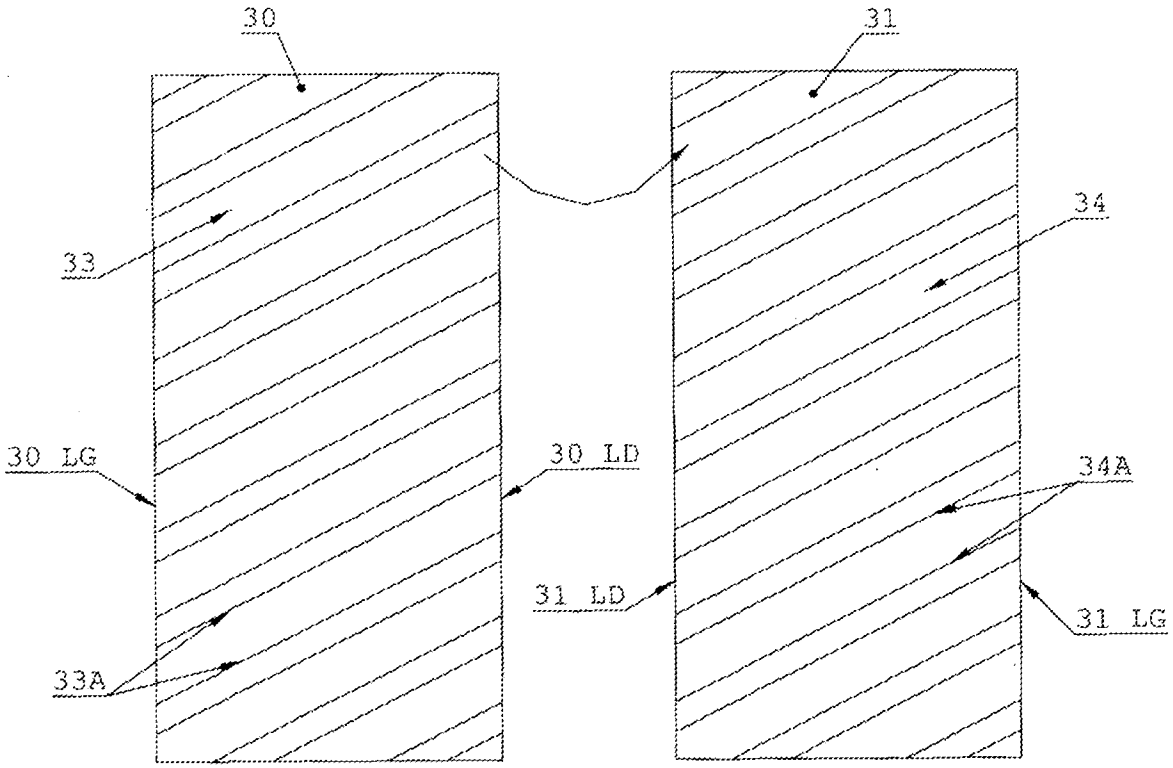
FIG. 16 is a partial plan view of the faces of the sheets supporting each other to form the element, a section of which is represented in FIG. 15.

FIG. 1 represents a heat exchanger body 1 between at least a first fluid FB and a second fluid FA. The exchanger body 1 is adapted to be housed in a conduit 2 (shown with dotted lines) in which the first fluid FB flows, this exchanger body comprising:

an element 3 situated at least partially in this conduit 2, this element 3 consisting of two sheets 30, 31 (see FIGS. 15 and 16) made of a heat conducting material, these sheets being connected to each other at least in the vicinity of their longitudinal edges 30A, 30B, 31A, 31B to define one or several internal channels 32 for this second fluid FA between them, this element 3 being wound to form a structure (3) at least partially in a spiral extending into this conduit 2 so as to define one or several channels 36 for the first fluid FB in the conduit between the external faces of adjacent spirals and at least one, preferably a series of substantially radial distributors 4 to convey this second fluid FA in the element 3 in the vicinity of a first longitudinal edge (30A, 31A) at the level of the different spirals and at least one, preferably a series of substantially radial collectors 5 to collect this second fluid FA after its passage in this element, each collector 5 being adapted to collect this second fluid in the vicinity of the second longitudinal edge (30B, 31B) at the level of the different spirals. The length of the exchanger or the exchanger body may be any in relation to the external diameter of the exchanger body. In an advantageous embodiment the exchanger body has a length L less than the diameter D of the exchanger body 1. In this document diameter of the exchanger body is understood to be its equivalent diameter measured in a perpendicular plane to the central axis of the spiral, that is to say the ratio between 4 times the surface defined by the most external spiral and the perimeter of the most external spiral. The ratio between the diameter of the most external spiral or the furthest from its axis and the length of the exchanger body advantageously is between 0.3 and 30, preferably between 0.5 and 5.

The first sheet 30 and the second sheet 31 forming the element 3 (see FIG. 16) are deformed to form a first series of channels 33 and a second series of channels 34 respectively along their faces having to be turned towards each other. The end edge 33A of the channels 33 of the first series of the face of the first sheet 30 turned towards the second sheet 31 is in contact with the end edge 34A of one or several channels 34 of the second series of the second sheet 31, forcing this second fluid FA to follow a path between one or several distributors 4 and one or several collectors, this path being formed by both the channels of the first series and the channels of the second series. (see FIGS. 15-16)

The depth P33, P34 of the channels 33, 34 of the first series and the second series is less than 10 mm, advantageously less than 7 mm, preferably less than 5 mm, more specifically between 1 mm and 4 mm.

The maximum width Larg of the channels 33, 34 of the first series or the second series is less than 30 mm, advantageously less than 15 mm, preferably less than 10 mm, from 3 to 7 mm for example.

The minimum radial distance drm or radial distance separating the faces of the bottoms of the channels 33, 34 of two successive spirals turned towards each other is between 1 mm and 100 mm, advantageously between 5 mm and 70 mm, preferably between 8 mm and 50 mm. This minimum distance corresponds substantially to the sum of the depths P33, P34 of the channels.

The path of the second fluid FA between the distributor 4 and the collector 5 advantageously has at least one substantially curved component following the winding of a spiral over at least 30°, advantageously over at least 45°. This allows the heat exchange to increase.

The path of the fluid FA between the distributor 4 and the collector 5 has an axial component, the length of which corresponds subbstantially to the axial length L of the exchanger body 1.

The sheets 30, 31 forming the element in a spiral are attached (advantageously welded) substantially in a continuous way to each other substantially along their longitudinal edges 30LG, 30LD, 31LG, 31LD (the edge 30LG being attached or welded to the edge 31LG, whereas the edge 30LD is attached or welded to the edge 31LD); and in a discontinuous way (point by point) between these longitudinal edges 30LG, 30LD, 31LG, 31LD.

The element in a spiral may also be obtained by folding a sheet so that one part of the sheet covers the other part of the sheet. In this case a longitudinal edge is made by the folding line.

The sheets 30, 31 advantageously are attached or welded to each other in a series of points between these longitudinal edges 30LG, 30LD, 31LG, 31LD. These points are at a distance from each other and do not form a continuous welding seam, but a network of distinct welding points. In this document welding or attaching point situated between these longitudinal edges is understood to be a welding or attaching area defining a welding surface or an attaching surface of at least 100 $mm^2$, advantageously at least 50 $mm^2$, particularly 1 $mm^2$ or less. Such welding or attaching points advantageously are made by laser welding.

The number of welding or attaching points is important. This number of points for welding or attaching the sheets to each other between their longitudinal edges advantageously is more than 100 per $m^2$, advantageously more than 1000 per $m^2$, preferably more than 5000 per $m^2$. The density of welding points is distributed advantageously in a substantially homogenous way. Therefore, if an area of 1 $m^2$ of surface extending from a first longitudinal edge of the sheets as far as the second longitudinal edge of the sheets has a density of welding or attaching points DPS, each square sub area of 100 $cm^2$ extending in this area of 1 $m^2$ has a density of welding or attaching points of between 0.5×DPS and 1.5×DPS, particularly between 0.75×DPS and 1.25×DPS.

Figure 22A:
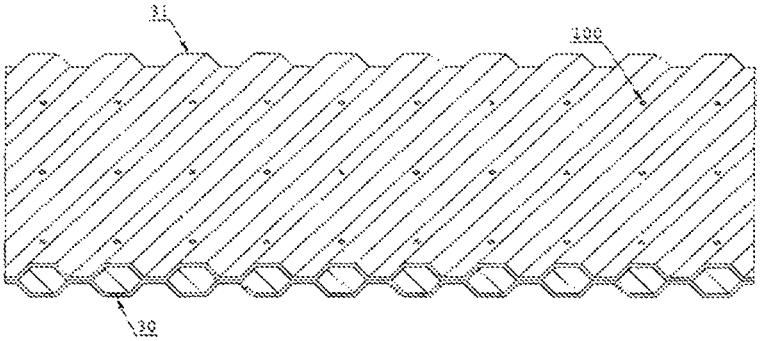
Figure 22B:
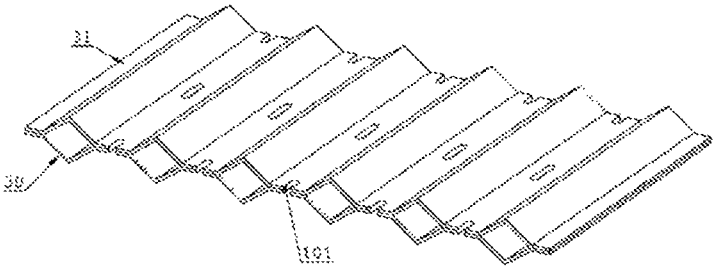
Figure 22C:
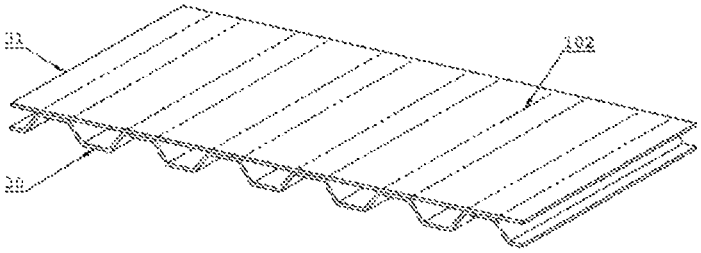
Figure 22D:
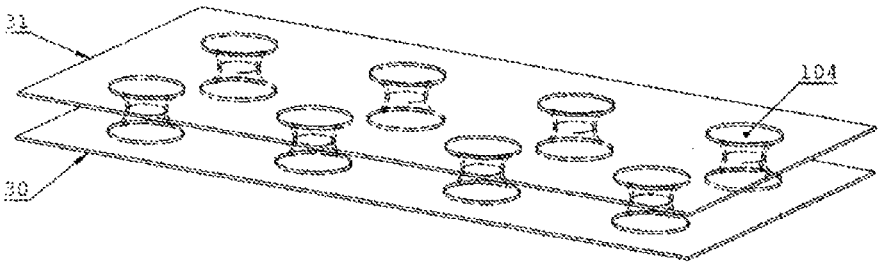
Figure 22E:
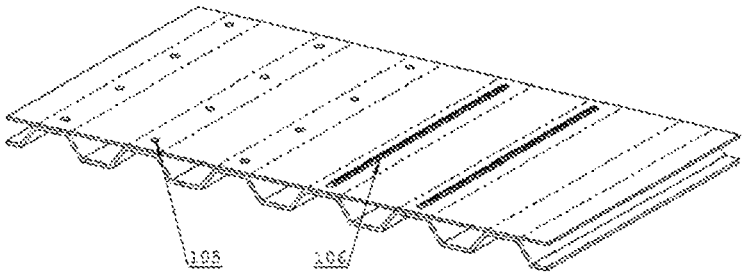

FIGS. 22A to 22E show different means for attaching the sheets to each other. In FIG. 22A the sheets are connected to each other by gluing points 100. In FIG. 22B the sheets are connected to each other by shaping in the areas 101. In FIG. 22C the sheets 30, 31 are connected to each other by aligned soldering areas 102 for example. In FIG. 22D the sheets 30, 31 are connected to each other by a series of studs 103, each with a central passage 104. In FIG. 22E the sheets 30, 31 are connected to each other by welding points 105 and by welding lines 106. It is clear that the embodiments of hoops are only examples and that other profiles and means for attaching are possible.

In the embodiment in FIG. 1 the exchanger body 3 comprises a central channel 35 that, if it is open, may allow the passage of the first fluid FB and a series of passages 36 defined between the spirals of the exchanger body 3. The fluid FB crossing the central passage provides a low loss of load for the fluid FB and mixes with the fluid FB leaving the passages 36. The fluid FA flows in the channels 33, 34 formed between the two sheets 30, 31, this fluid being conveyed by the radial distributors 4 and being collected by the radial collectors 5. The radial distributors 4 are at a distance from each other and have a passage section (perpendicular to the average flow of FA flowing in a distributor 4) that reduces between the inlet of the distributor and the last outlet of the distributor. The distributor has a series of openings in the form of slots forming a passage for the fluid FA with the internal space 33, 34 of the spirals defined between the sheets 30, 31. The slots and the section of the distributor are selected to provide a substantially constant flow of fluid FA per unit of volume of the channels 33, 34. Therefore a greater quantity of fluid FA is introduced into the spiral furthest away from the axis of the body in a spiral 3. The fluid FA is conveyed to the different distributors by an external crown 40 conveying the fluid FA to the distributors. This crown advantageously is associated with a flange for attaching the conduit 2 to another conduit for the fluid FB. In a similar way the collectors 5 are connected to an external crown 50 to collect the fluid FA leaving the collectors 5. This crown 50 advantageously is also associated with a flange.

In the embodiment the exchanger body is of the counterflow type, the fluid FB flowing in a direction from a first end (30B, 31B) of the exchanger body towards the second end (30A, 31A) of the exchanger body 3, whereas the fluid FA flows from the second end (30A, 31A) of the exchanger body towards the first end (30B, 31B), but in the channels 33, 34 formed between the sheets 30, 31.

It is obvious that the direction of movement of the fluid FB may be changed, if an exchanger of the parallel flow type or an exchanger of the crossflow type is desired.

In the embodiment in FIGS. 11 to 14 the fluid FA is conveyed in the channels 33, 34 formed between the sheets 30, 31 along both a first longitudinal edge of the sheets 30, 31 and the second longitudinal edge of the sheets 30, 31. Likewise the fluid FA is collected on both sides of the exchanger body 3. The distributors 4 are connected to each other by a conduit 60, 61 for example, whereas the fluid FA leaving the collectors is conveyed to the conduits 62, 63 for example.

In the embodiment drawn in FIG. 1 the central channel 35 may be blocked at the first end to prevent the fluid FB from passing.

Figure 4:
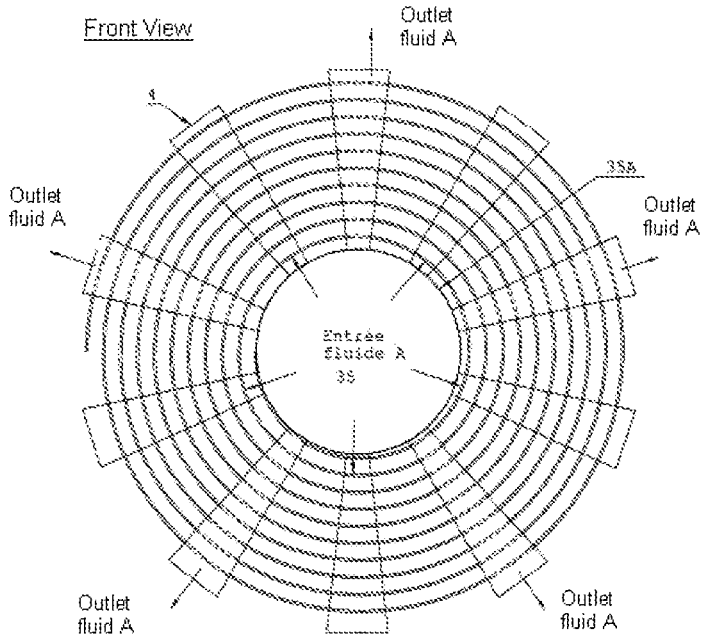
FIG. 4 is a front view of another embodiment of an exchanger body according to the invention.
Figure 5:
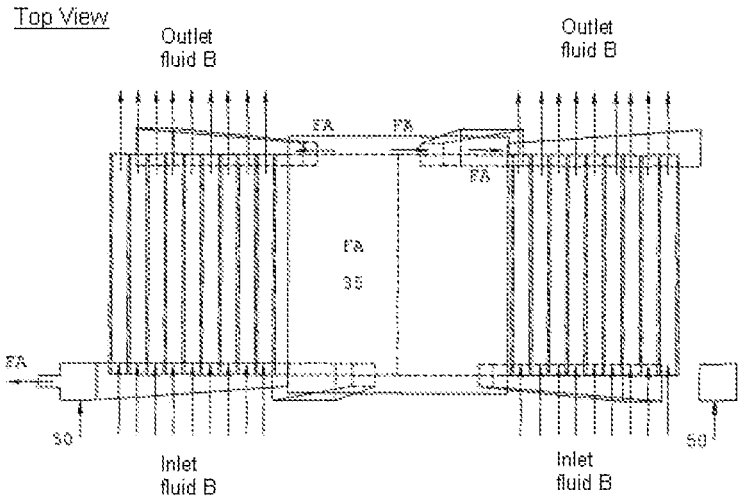
FIG. 5 is a top view of the exchanger body in FIG. 4.

In the embodiment in FIGS. 4 and 5 the central channel serves as a means for conveying the fluid FA to the distributors 4, the fluid leaving the channels 33, 34 formed between the sheets 30, 31 is collected in the collectors 5 to be removed via an external crown 50. The central channel 35 is formed by a tube 35A adapted to prevent the passage of the fluid FB in this central channel 35. The distributor 4 preferably has a larger passage section in the vicinity of the channel 35 than in the vicinity of its end at a distance from the channel 35.

Figure 6:
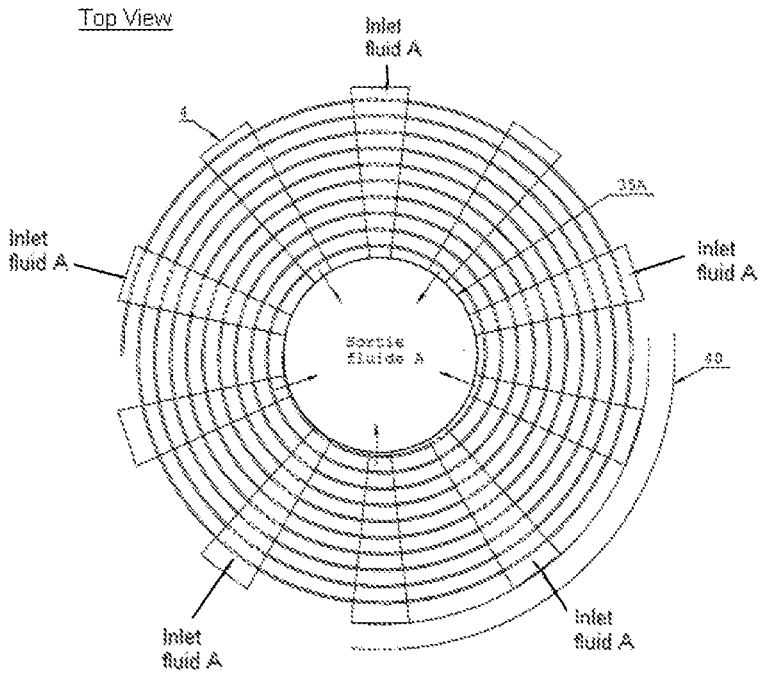
FIG. 6 is a front view of an embodiment similar to that in FIG. 4.
Figure 7:
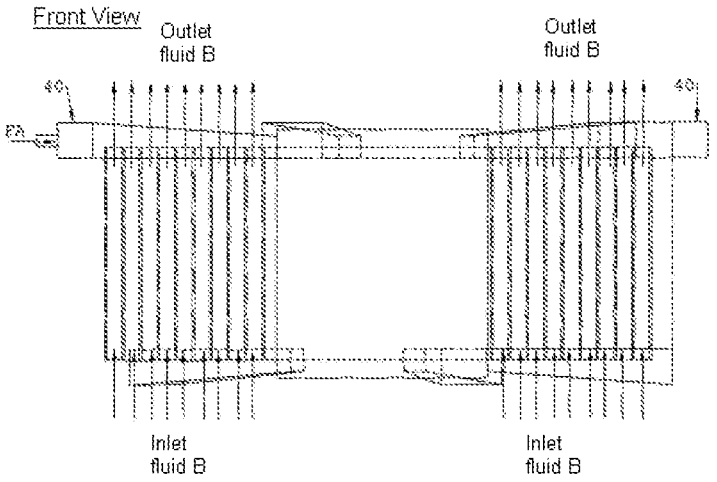
FIG. 7 is a top view of the exchanger body in FIG. 6.

The embodiment in FIGS. 6 and 7 is similar to that in FIGS. 4 and 5, only the fluid FA is conveyed by an external crown 40 (conveying the fluid FA connecting the different distributors 4 to supply them with the fluid FA) and is collected by the collectors 5 conveying the fluid FA in the central channel 35.

Figures 8, 9, 10:
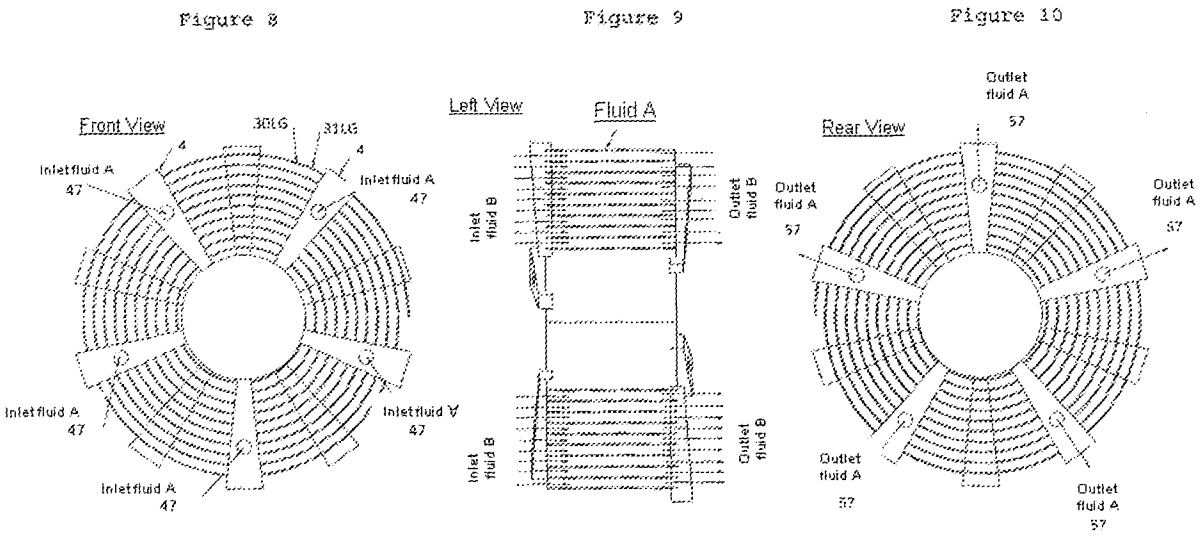
FIG. 8 is a front view of another embodiment similar to that in FIG. 4.
FIG. 9 is a top view of the exchanger body in FIG. 8.
FIG. 10 is one of a detail of an exchanger body according to the invention.
Figure 11:
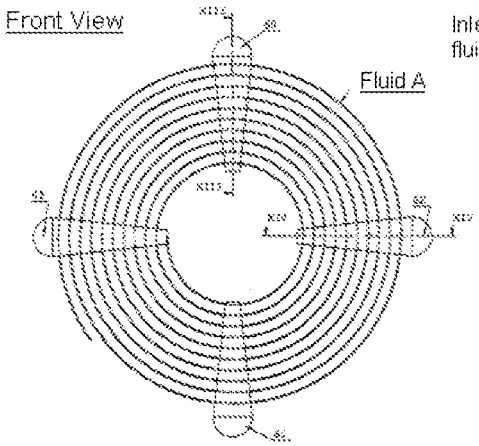
FIG. 11 is a top view of an embodiment similar to that in FIG. 4.
Figure 13:
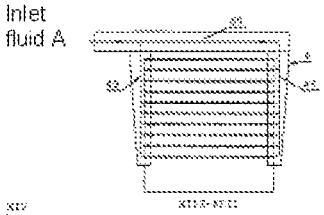
FIGS. 13 and 14 are sectional views along lines XIII-XIII and XIV-XIV of the exchanger body in FIG. 11.
Figure 12:
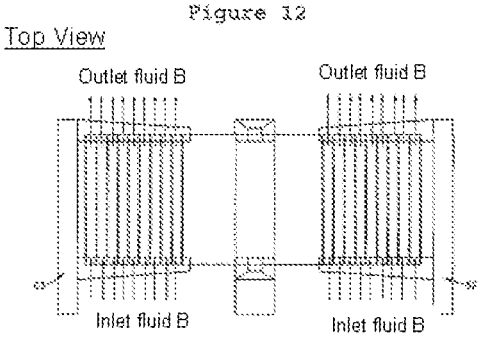
FIG. 12 is a side view of the exchanger body in FIG. 11.
Figure 14:
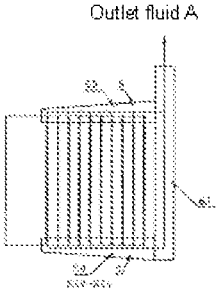

In the embodiment in FIGS. 8 to 10 the distributors 4 are supplied in a separate way, each distributor 4 having an opening 47 situated along the face extending in a perpendicular plane to the central axis of the exchanger body for example). This separate supply allows control of the quantity of the fluid FA conveyed to each of the distributors 4. The collectors 5 are also each fitted with a drain 57. The location of the opening 47 and the outlet 57 advantageously is situated substantially halfway along the different openings allowing the passage of the fluid FA towards or out of the channels defined between the sheets 30, 31.

Therefore in embodiments the distributors may be used to be supplied in the vicinity of the central channel and/or in the vicinity of the periphery and/or by an intake situated between the end adjacent to the central channel 35 and the peripheral end, in a median position for example. In possible embodiments the distributors are supplied at several points or in distinct areas. Likewise therefore in the embodiments the collectors may be used to collect the fluid in the vicinity of the central channel and/or in the vicinity of the periphery and/or by a drain or outlet situated between the end adjacent to the central channel 35 and the peripheral end, in a median position for example. In possible embodiments the collectors are supplied at several points or in distinct areas.

Figure 17:
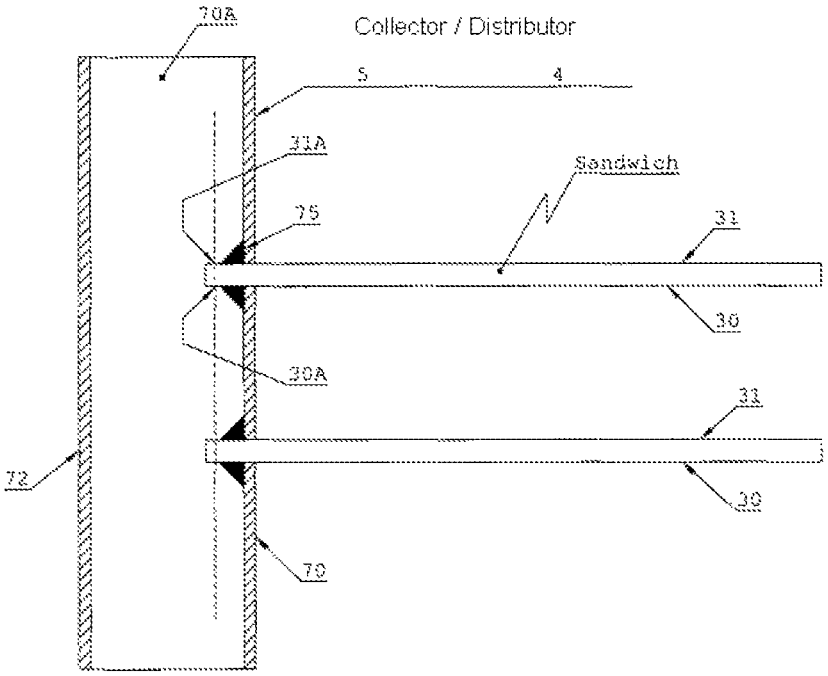
FIG. 17 is a diagrammatic view of an embodiment of a distributor or collector of the fluid FA flowing in the channels formed between the two sheets forming the exchanger body.
Figure 18:
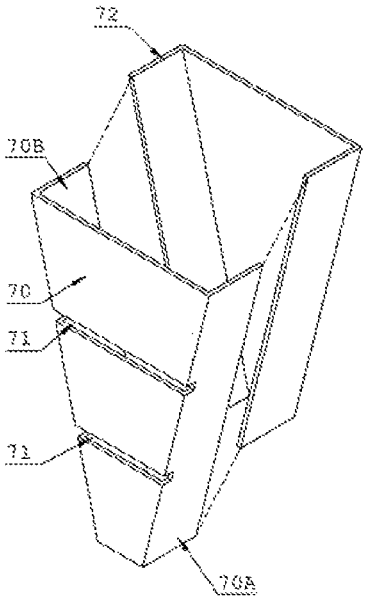
FIG. 18 is a diagrammatic, perspective and exploded view of a distributor or a collector in FIG. 17.

FIG. 17 is a sectional view showing an advantageous means for putting the channels 33, 34 defined between the sheets 30, 31 into communication with a collector or a distributor 4, 5. The sandwich assembly of the sheets 30, 31 is wound to form a spiral with a distance E between the spirals defined by the sheets. A flat 70 with vanes 70A, 70B and a series of slots 71 extending partially into the vanes is placed along one end 30A, 31A of the assembly wound in a spiral so that each of the spirals formed by the two sheets 30, 31 is partially engaged in one of the slots 71. Then sealing between the spirals and the flat 70 and its vanes 70A, 70B is provided by means of a welding seam 75 or a seal. Then the end of the part of the spiral engaged in the slot 71 between the vanes 70A, 70B is cut (dotted lines) so as to create an opening between the volume defined behind the flat 70 and the internal volume of the spirals. Then the flat 70 is associated with a cover 72 so as to form a channel able to serve either to distribute the fluid FA to the different spirals or to collect the fluid FA leaving the different spirals. (see FIG. 18)

Figure 19A:
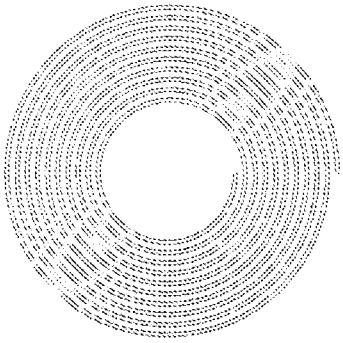
FIGS. 19A, 19B and 19C are sectional, diagrammatic views of the element consisting of two sheets attached to each other and represented by a single line, this element being wound on itself to form spirals adjacent to but at a distance from each other.
Figure 19B:
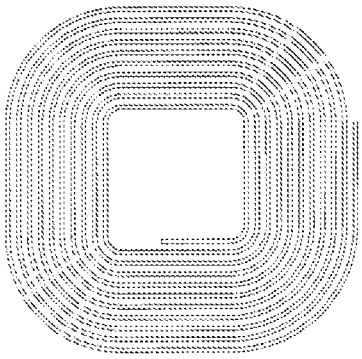
Figure 19C:
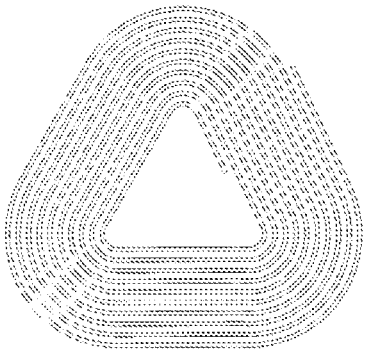
Figure 20:
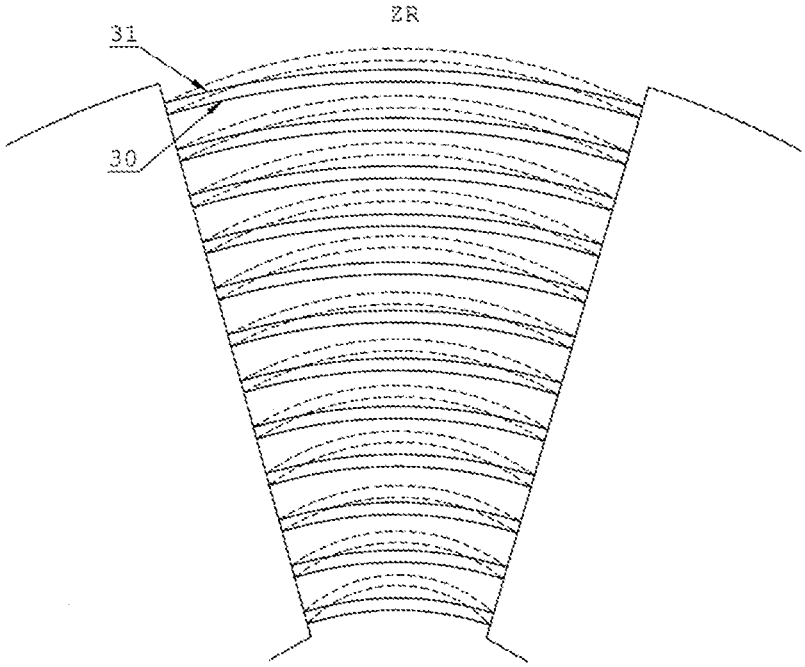
FIG. 20 shows a radial area of the element wound on itself in a diagrammatic and sectional way, this area having a curve adapted to take up and control the effect of expansion between the sheets and between the spirals.

FIGS. 19A to C are sectional, diagrammatic views of the element consisting of two sheets 30, 31 attached to each other and represented by a single line, this element being wound on itself to form spirals that are adjacent to but at a distance from each other. In FIG. 19A the element is wound in the anticlockwise direction with a substantially circular section, whereas in FIGS. 19B and 19C the section of a spiral is substantially square and triangular respectively.

Though the effect of expansion may be taken up at least partially through the choice of the metal, this effect may also be taken up through the radial areas ZR of the element 1, all the spirals of the element in the radial area ZR have a curve adapted to follow a controlled expansion for example. The part of the spirals of the ZR area after expansion is represented by dotted lines.

Naturally other means for taking up the effects of expansion are possible.

As represented in the figures, the distributors 4 and the collectors 5 have a passage section that widens the further away from the central axis of the exchanger body it is, this is to control the flow of the fluid FA in the distributor and the collector.

FIGS. 23A to H show the assembly of the sheets 30, 31 to be wound to form the element 1 in a diagrammatic and sectional way.

Figure 23A:
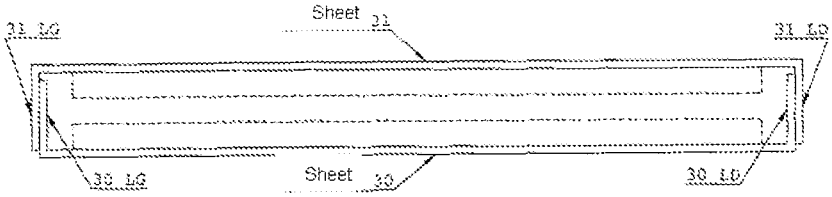

In FIG. 23A the edges of the sheets 30, 31 are superimposed to define a minimum distance along the end edges 30LD, 30LG; 31LD, 31LG.

Figure 23B:
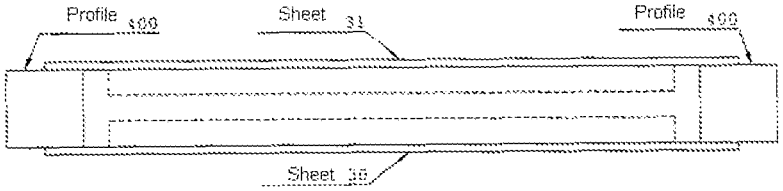

In FIG. 23B the edges of the sheets 30, 31 are connected to each other by means of a profile 400.

Figure 23C:
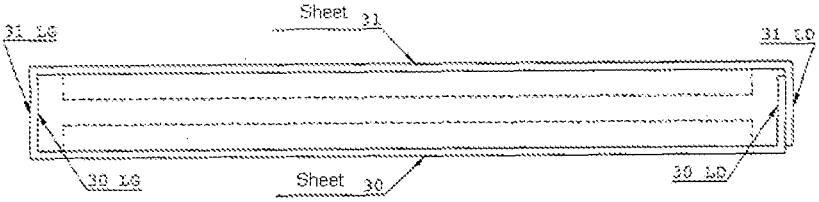

In FIG. 23C a sheet is folded on itself to form the section 31 and the section 30 as well as the longitudinal edges. In this embodiment the edges 30LG, 31LG are connected to each other by folding the sheet, whereas the edges 30LD, 31LD are connected to each other by the end flats of the sheet covering each other and attached to each other by means of a welding seam or a gluing seam for example.

Figure 23D:
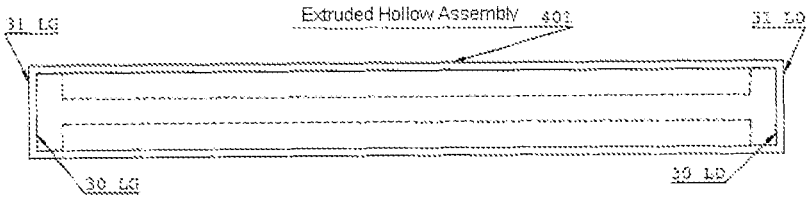

In FIG. 23D the assembly to be wound in a spiral consists of a hollow assembly 401 that is extruded, in this way forming the edges 30LD, 31LD and 30LG, 31LG connected to each other. After being shaped to define the channels between the sheets 30, 31 this assembly is wound in a spiral. Such an assembly is made of plastic material for example.

Figure 23E:
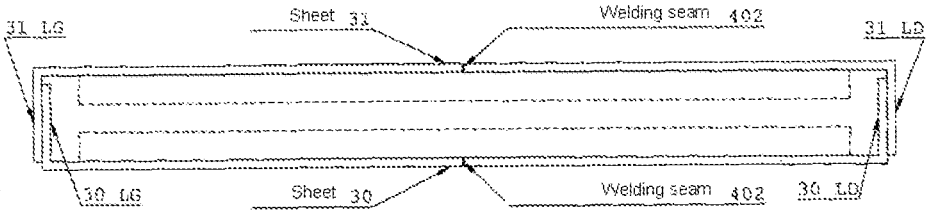

FIG. 23E is a transverse, sectional view of an assembly similar to the assembly in FIG. 23A, only the sheets 30, 31 are made by two sections connected to each other by a welding seam 402.

The channels formed between the two sheets represented in FIG. 23 are represented diagrammatically.

Figure 23F:
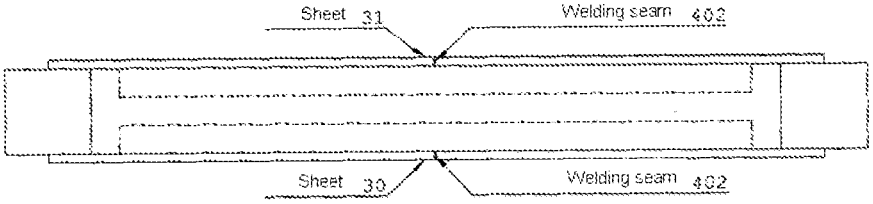
Figure 23G:
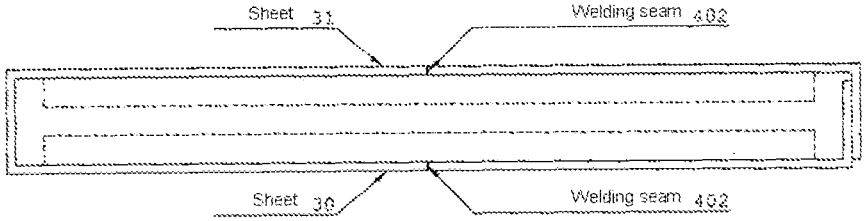
Figure 23H:
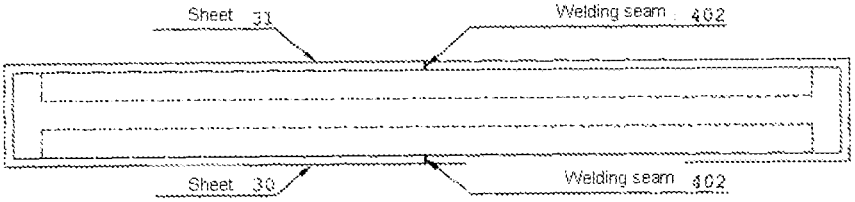

The embodiments in FIGS. 23F, 23G and 23H are similar to the embodiments in FIGS. 23B, 23C and 23D, only the sheets 30, 31 are each made up of two distinct parts connected to each other by a welding seam 402.

The exchanger body represented in the figures may be placed in a chamber C1 of an exchanger fitted with a conduit 100 to convey the fluid FB, another conduit 101 to remove the fluid FB after its passage through the exchanger body, a conduit to convey the fluid FA towards the distributors 4 and a conduit to remove the fluid FA collected by the collectors 5. The fluid FB is conveyed in a prechamber C2 comprising a wall 103 adapted to distribute the fluid in the passages formed between successive spirals. This wall 103 is fitted with fins for example to generate a certain diagonal or sloping movement of the flow FB in the passages formed between the spirals. This then allows the heat exchange rate to increase.

Figure 21:
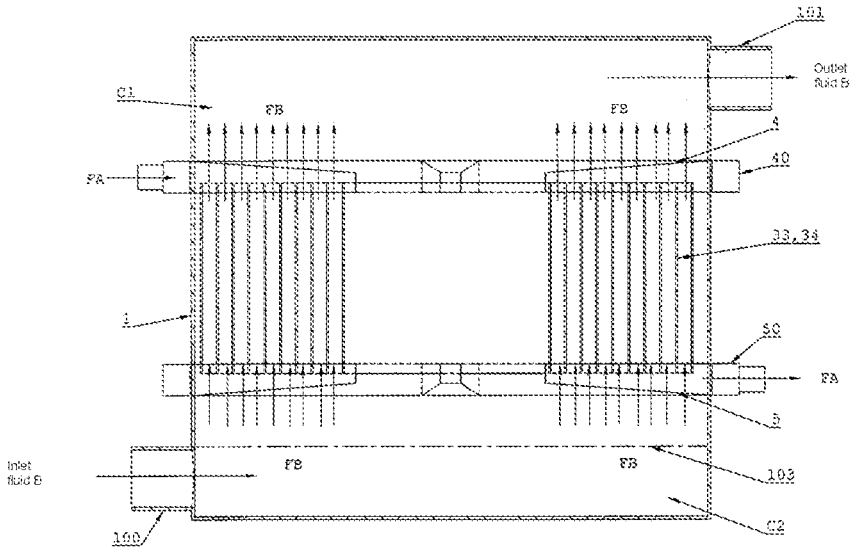
FIG. 21 is a diagrammatic, sectional view of an exchanger according to the invention.

Such an exchanger 100 represented in FIG. 21 allows calories or frigories to be transferred between at least a first fluid FB and a second fluid FA. In this exchanger the first fluid FB is conveyed in the channels formed between the faces of adjacent spirals of the element wound at least partially in a spiral, whereas the second fluid is distributed via radial distributors 4 (supplied with fluid by the crown 40) in the internal channels 33, 34 of the element in the vicinity of a first longitudinal edge of the element and in which the second fluid FA is collected after its passage in the internal channels of the element 1 via one or several radial collectors.

Several exchanger bodies may be associated in one and the same exchanger if necessary.

The invention claimed is:

1. An exchanger body adapted to be placed in a guiding envelope selected from the group consisting of a conduit and a chamber adapted to guide a flow of a first fluid in or towards the exchanger body adapted to exchange heat between said first fluid and a second fluid, said exchanger body comprising:

an element adapted to be situated at least partially in this guiding envelope, this element consisting of a first sheet defining a first face of the element and a second sheet defining a second face of the element, said first and second sheets being made of a heat conducting material and having each a first longitudinal edge and a second longitudinal edge, these first and second sheets being connected to each other at least in the vicinity of their first longitudinal edges for defining a first longitudinal edge of the element and in the vicinity of their second longitudinal edges for defining a second longitudinal edge of the element, whereby defining at least one internal channel for this second fluid in the element between said first and second longitudinal edges of the element, this element being wound to form a structure at least partially in a spiral extending into this guiding envelope, said spiral defining at least one outer channel for the first fluid outer the element wound to form a structure at least partly in a spiral, whereby two successive spirals of the element are distant the each from the other by a radial distance, at least one substantially radially-extending distributor extending along a radial direction from adjacent a central axis of the exchanger body to beyond an outermost spiral of the element, wherein the distributor is configured to convey this second fluid in the element in the vicinity of a first longitudinal edge of the element at the level of portions of the first longitudinal edge of the element wound to form a structure at least partly in a spiral, said portions extending along the radial direction of the at least one distributor, and at least one substantially radially-extending collector extending along a radial direction from adjacent the central axis of the exchanger body to beyond the outermost spiral of the element, wherein the collector is configured to collect this second fluid after its passage in the element, this collector being adapted to collect this second fluid in the vicinity of the second longitudinal edge of the element at the level of portions of the second longitudinal edge of the element wound to form a structure at least partly in a spiral which are extending along the radial direction of the at least one collector, in which the first sheet of the element is deformed to form a first series of depressed areas forming a series of first channels extending each between two edges, while the second sheet of the element is deformed to form a second series of depressed areas forming a series of second channels extending each between two edges, the two edges of the first channels of the first series of the depressed areas of the first sheet turned towards the second sheet contacting the edges of a plurality of second channels of the second series of depressed areas of the second sheet, forcing this second fluid to follow a path between the distributor and the collector, this path being formed by both the first channels of the first series of depressed areas of the first sheet and the second channels of the second series of depressed areas of the second sheet, in which the first series of depressed areas forming a series of first channels of the first sheet and the second series of depressed areas forming a series of second channels of the second sheet have each a depth of less than 10 mm, a maximum width of less than 30 mm, and in which a radial distance between a first spiral of the element and a second spiral successive to the first spiral of the element is measured between the outer face of the bottom of a channel of the first sheet and the outer face of the bottom of a channel of the second sheet, said radial distance being comprised between 1 and 100 mm.

2. The exchanger body of claim 1, in which the radial distance between the first sheet of a first spiral of the element and the second sheet of a second spiral successive to the first spiral of the element is measured between the outer face of a portion of the first sheet between two depressed areas of the first spiral and the outer face of a portion of the second sheet between two depressed areas of the second spiral, said radial distance being comprised between 5 mm and 70 mm.

3. The exchanger body of claim 1, in which the path between the at least one distributor and the at least one collector has at least one local curved component following at least the winding of a portion of the spiral over an angular area of at least 15°.

4. The exchanger body of claim 1, in which the first and second sheets forming the element wound in a spiral are welded to each other substantially along their longitudinal edges and in a discontinuous way between these longitudinal edges.

5. The exchanger body of claim 1, in which the first and second sheets are welded together or attached to each other in a series of areas and/or points between the longitudinal edges of the sheets.

6. The exchanger body of claim 5, in which the series of areas and points for attaching the first and second sheets to each other between their longitudinal edges comprise more than 100 distinct welding areas and points per $m^2$ substantially homogeneously distributed.

7. The exchanger body of claim 1, comprising at least two radial distributors and at least two radial collectors, in which the element wound in spiral has element portions selected from the group consisting of portions extending between two successive radial distributors and portions extending between two successive collectors, and in which the exchanger body comprises at least one control means controlling the expansion of at least one of said element portions of the element wound in spiral.

8. The exchanger body of claim 7, in which the control means controlling the expansion of the at least one of said element portions of the element wound in spiral are aligned substantially along a radial plane.

9. The exchanger body of claim 1, in which the at least one radial distributor and the at least one radial collector have a passage section that widens the further away from the central axis of the exchanger body it is.

10. The exchanger body of claim 1, in which the at least one radial distributor is associated with at least one guiding means guiding the first fluid entering into the outer channel defined by the spiral.

11. The exchanger body of claim 1, which has a central axial channel serving to convey the second fluid towards the at least one distributor.

12. The exchanger body of claim 1, in which the first and second sheets of the element are connected together for defining several internal channels for the second fluid between said first and second longitudinal edges of the element.

13. The exchanger body of claim 1, in which the spiral is adapted for defining in the guiding envelope several channels for the first fluid between the first face and the second face of the element wound to form a structure at least partly in a spiral.

14. The exchanger body of claim 1, which comprises at least two radial distributors, each of said at least two radial distributors extending along a radial direction for conveying the second fluid in the element in the vicinity of the first longitudinal edge of the element at the level of portions of the first longitudinal edge of the element wound to form a structure at least partly in a spiral which are extending along the radial direction of the radial distributor considered.

15. The exchanger body of claim 1, which comprises at least two radial collectors, each radial collector considered of said at least two radial collectors extending along a radial direction for collecting the second fluid after its passage in the element in the vicinity of the second longitudinal edge of the element at the level of portions of the second longitudinal edge of the element wound to form a structure at least partly in a spiral which are extending along the radial direction of the considered radial collector.

16. The exchanger body of claim 1, in which the channels of the first series and of the second series have each a depth of less than 7 mm.

17. The exchanger body of claim 1, in which the channels of the first series and of the second series have each a depth comprised between 1 mm and 4 mm.

18. The exchanger body of claim 1, in which the channels of the first series and of the second series have each a maximum width of less than 15 mm.

19. The exchanger body of claim 1, which the outer channel is defined between the first face and the second face of the element turned towards each other which are distant radially the one from the other from a distance between 5 mm and 70 mm.

20. The exchanger body of claim 1, in which the path between the distributor and the collector has at least one local curved component following at least the winding of a portion of the spiral over an angular area from 30° to 90°.

21. The exchanger body of claim 1, in which the at least one radial collector is associated with at least one means for guiding the first fluid entering into the outer channel defined by the spiral.

22. The exchanger body of claim 1, which has a central axial channel serving to convey the second fluid towards the at least one collector.

23. The exchanger body of claim 1, which has a central axial channel adapted for connecting the exchanger body to another exchanger body.

24. The exchanger body of claim 1, which has a central axial channel adapted for receiving another exchanger body.

* * * * *